US005796020A

United States Patent [19]

Truitt

[11] Patent Number: 5,796,020

[45] Date of Patent: Aug. 18, 1998

[54] HAND-MANIPULATED SHARPING LEVER FOR A HARP

[76] Inventor: Betty R. Truitt, P.O. Box 211, Mt. Laguna, Calif. 91948-0211

[21] Appl. No.: 792,958

[22] Filed: Jan. 22, 1997

Related U.S. Application Data

[63] Continuation-in-part of Ser. No. 597,600, Feb. 6, 1996, abandoned.

[51] Int. Cl.[6] ..... G10D 1/04

[52] U.S. Cl. ..... 84/266; 84/264

[58] Field of Search ..... 84/264, 265, 266

[56] References Cited

U.S. PATENT DOCUMENTS

| | | | |
|---|---|---|---|
| 485,354 | 1/1892 | Rath | 84/266 |
| 617,514 | 1/1899 | Robbins | 84/266 |
| 737,693 | 9/1903 | Audet, Jr. | 84/285 |
| 744,104 | 11/1903 | Rath | 84/266 |
| 1,134,207 | 4/1915 | Kirk | 84/266 |
| 1,332,885 | 3/1920 | Buckwell | 470/79 |
| 1,406,347 | 2/1922 | Clark | 84/266 |
| 2,169,938 | 8/1939 | Wallen | 84/266 |
| 2,241,284 | 5/1941 | Walder | 84/312 R |
| 3,739,680 | 6/1973 | Christiansen | 84/266 |
| 4,936,182 | 6/1990 | Bunker | 84/266 |
| 5,140,883 | 8/1992 | Fay | 84/266 |

OTHER PUBLICATIONS

*Musicians Keep Book 1994–1995*, pp. 1–5 (catalogue).

Sadie (ed.), *The New Grove Dictionary of Musical Instruments*, vol. 2, "Harp," pp. 132–164 (1984).

Sadie (ed.), *The New Grove Dictionary of Music and Musicians*, vol. 8, "Harp," pp. 190–210 (1980).

*Primary Examiner*—Michael L. Gellner

*Assistant Examiner*—Shih-yung Hsieh

*Attorney, Agent, or Firm*—Brown, Martin, Haller & McClain, LLP

[57] ABSTRACT

A sharping lever for a folk harp is described which avoids detrimental aspects of prior art levers while providing simple and effective sharping of a harp string and obtaining of true tone quality. The unique configuration of the supporting base, the fret pin and the handle, in which the string rests on the fret pin which in turn rests directly on the base, providing firm contact, allows the device to sharpen the tone of a harp string in a manner which allows for true tone quality to occur. The disclosed sharping lever is mounted on the harp and when in contact with the string, the harmonic tone of the string is raised, and the pressure of the string on the sharping lever is transmitted directly through the support to the harp without vibration or distortion of the raised tone of the harp. Preferably the sharping lever will be positioned and operated such that the string's harmonic tone is raised by one-half tone. The sharping lever may also include an adjustable holding stop to secure certain types of strings against the fret pin. The sharping lever can be made of metallic or non-metallic material, but is preferably of metal and formed by machining, which results in precise bends and curves, a flat base and ample provision for securing and properly aligned mounting of the sharping lever on a harp neck. The invention also includes harps which incorporate the sharping lever.

20 Claims, 3 Drawing Sheets

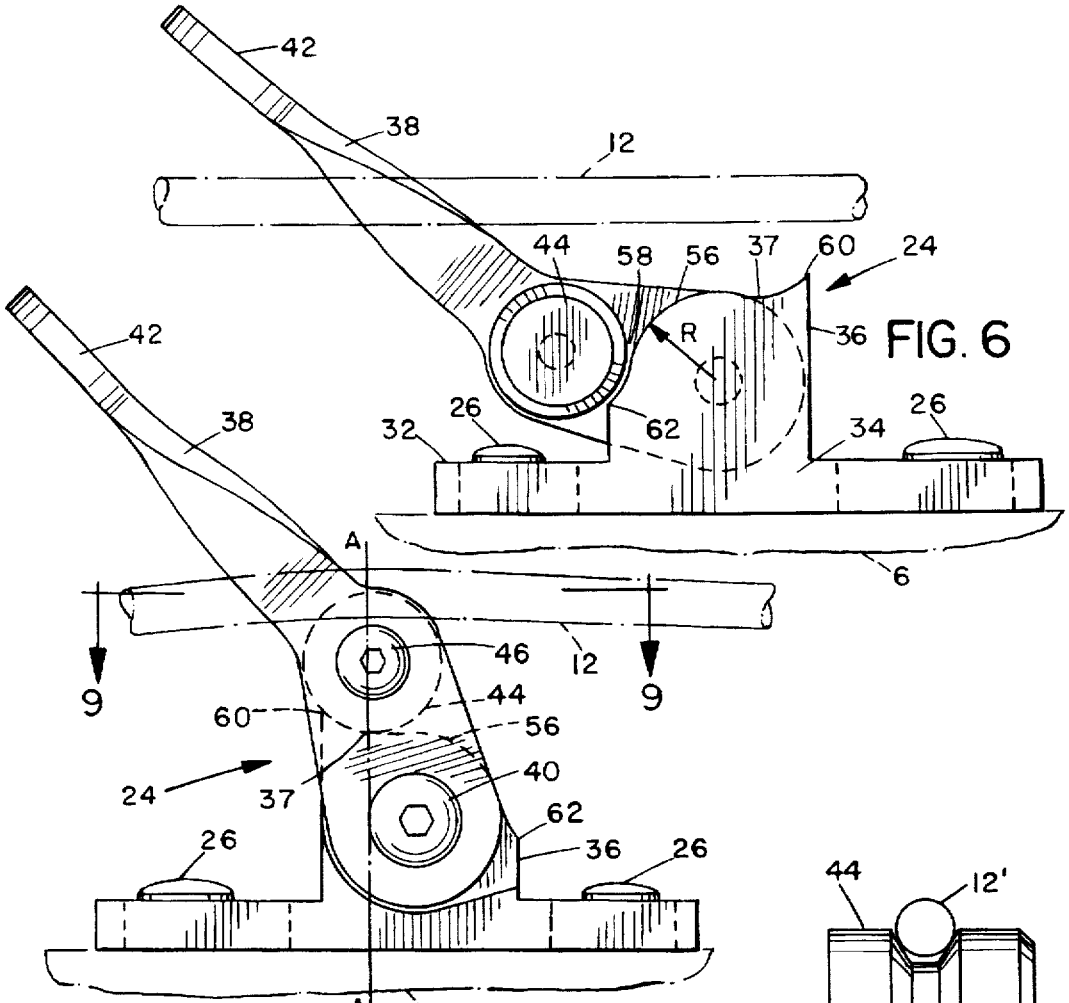
FIG. 6
FIG. 7
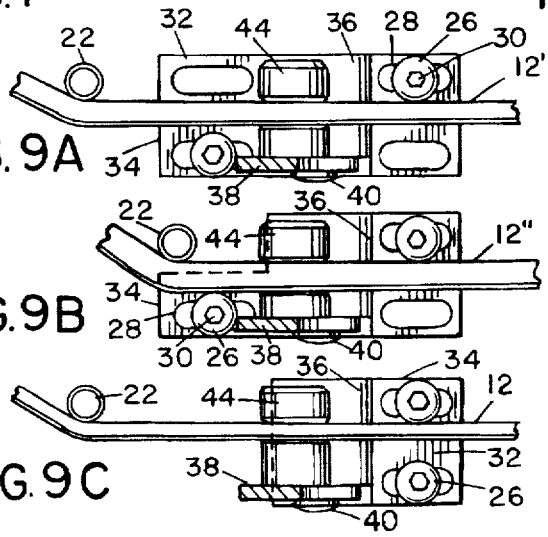
FIG. 9A
FIG. 9B
FIG. 9C
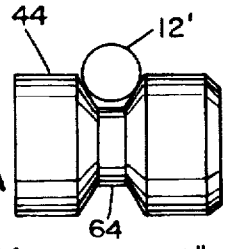
FIG. 8A
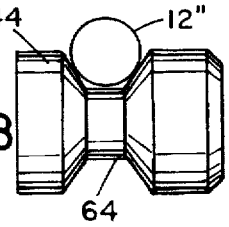
FIG. 8B
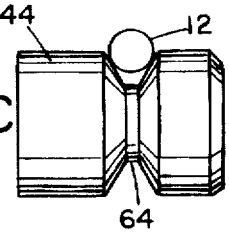
FIG. 8C

HAND-MANIPULATED SHARPING LEVER FOR A HARP

CROSS-REFERENCE TO RELATED APPLICATION

This application is a continuation-in-part of application Ser. No. 08/597,600, filed Feb. 6, 1996, of like title, now abandoned.

BACKGROUND OF THE INVENTION

1. Field of the Invention

The invention herein relates to musical instruments. More particularly it relates to harps and to hand-manipulated sharping levers therefor.

2. Description of the Prior Art

In its basic configuration the harp, as a stringed instrument, is capable of producing only one harmonic tone or note per string. Since each harp string is secured at each of its ends, it has a fixed harmonic length between those ends which corresponds to a single note or tone. It has long been recognized, however, that harmonic tone can be changed by shortening the string or by putting the string under increased tension. Over the last two centuries, a number of different devices have been developed and described which produce such shortening. Each in some way interposes a fret pin or similar obstruction against the string at a point along the string between the two fixed ends, usually positioned at a short distance from one or the other of the ends. Since shortening the length of the string raises its harmonic tone, in effect sharpening the note, these devices have been known as sharping devices.

The position of the contact point for the fret pin is normally selected such that a semitone (i.e., one-half tone) increase in the string's original tone is produced. The point at which the sharping lever engages the string is 1/18th of the vibrating length of the unsharpened string, since the frequency of a sharp is the frequency of the natural times the 12th root of two. Thus, if the normal tuned length of the string produces a natural note (e.g., $C_1$), engagement of the sharping device will raise the note to $C_1$. Similarly, if the string is originally tuned to a flat such as $C_1$, the tone will be raised to $C_1$; see, for instance, Sadie, ed., *The New Grove Dictionary of Music and Musicians*, vol 8, "Harp," §8 (1980); Sadie, ed., *The New Grove Dictionary of Musical Instruments*, vol 2, "Harp," §4 (vi) (1984); Apel, Harvard Dictionary of Music, (2*d* ed.: 1969), "Harp," pp. 375–377; and Kennan, The Technique of Orchestration, (1952), ch. XV, pp. 229–231. If the sharping lever engages the string at any other point, the frequency of the note sounded will be different. Therefore accuracy of placement of the sharping lever is critical for achieving the frequency increase of exactly one-half tone.

There are two basic types of harp in common use today. The first is the "concert harp" or "pedal harp." Concert harps are usually large, rest on a base on the floor and are played by the harpist while he or she is seated behind the harp. Within the hollow neck of the concert harp is a complex set (usually seven in number) of parallel linkage mechanisms connected by rods in the forepillar to foot pedals at the base of the harp. Each pedal operates one linkage set and that linkage set sharps all of the strings that play integral multiples of a specific harmonic tone; i.e., all of the strings that play the same note spaced one octave apart. Thus the "A foot pedal" will simultaneously sharpen all A strings on the harp, the "B foot pedal" will sharpen all B strings, and so forth.

The basic mechanism which provides this sharping effect in concert harps has been known for almost two hundred years. A small circular plate which has two pins spaced diametrically opposite and projecting from the plate is disposed such that a string passes between the two pins. The linkage mechanism connects the plate and the respective pedal. In one position of the pedal the plate pins are not in contact with the string, and the tone produced by the full length string is heard. However, when the harpist pushes the pedal with his or her foot to a second position, the linkage rotates the plate and the two pins engage opposite sides of the string, bending the string into a shallow Z shape. The plate is positioned such that the impingement of the pins shorten the string by the length increment required to raise the string's note by one-half tone, thus converting a flat to a natural or a natural to a sharp. A refinement, also developed about the same time, and the predominant mechanism in use today, is a "double action" sharping system, in which two rotatable plates with pins are used with a single string. At the first pedal position both plates are disengaged from the string. Moving the foot pedal to a second position rotates both plates, but the plates are aligned such that at the second position only the pins on the plate closest to the end of the string is engaged, which raises the note of the string by one-half tone. Further movement of the pedal to a third position further rotates and engages the pins on the second plate, which is spaced further along the string from the end, and thus raises the note of the string by an additional one-half tone. By initially tuning the string to the flat of a note, a single string can thereafter be used to play the flat, natural or sharp of that note, depending on the positioning of the foot pedal. See, for instance, Sadie, *The New Grove Dictionary of Music and Musicians*, supra, "Harp," §9; Robbins, U.S. Pat. No. 617,514; and Rath, U.S. Pat. No. 744,104.

While the relevance of the operation of concert harps will be evident subsequently herein, the present invention is concerned not with concert harps but with the other predominant type of harp, commonly called the "folk harp." For the purposes of the discussion of this invention, a folk harp will be considered to be any harp in which the sharping of a string is accomplished with a hand operated device rather than through a pedal and its internal mechanical linkage. For a folk harp, in most cases the harper[1] manipulates the sharping device directly at the point of the string where the shortening will produce a semi-tone increase and therefore sharping action will occur.

[1] Currently a distinction is made in the designations of the harp player depending on the type of harp played. A "harpist" plays a concert harp while a "harper" plays a folk harp.

Folk harps are commonly available in a much wider variety of sizes and styles than are concert harps. The number of strings on folk harps may vary widely between small harps and larger ones. The distinction which is important for the present invention is that with folk harps, each sharping device is independent and operates only on a single string. Sharping devices on most folk harps are not linked and ganged between corresponding notes in different octaves, so they cannot be worked in unison by a single movement (i.e., pushing a pedal) by the harper. Further, since most folk harp sharping devices Currently a distinction is made in the designations of the harp player depending on the type of harp played. A "harpist" plays a concert harp while a "harper" plays a folk harp, incorporate some sort of lever action, they are commonly referred to as "sharping levers," to distinguish them from the "sharping pedals" of concert harps. See, for instance, Sadie, *The New Grove Dictionary of Music and Musicians*, supra, "Harp," §9;

Bunker, U.S. Pat. No. 4,936,182; and Christianson, U.S. Pat. No. 3,739,680.

The simple blade or hook sharping lever in use for several centuries lacks a secure stopping element, so the harper may turn it too much or too little while tuning, and the resulting engagement of the sharping device with the string will not always produce a true semi-tone, but rather one which may be too low or too high. Further, buzzing due to partial engagement and string fraying due to the device's rubbing on the string are also shortcomings of this type of sharping lever.

A major type of sharping lever for folk harps in use today is one which uses a lever in association with one or two pegs to impart the same kind of Z-shape bend or kink in the harp string that the rotating plates do in the concert harps. Typical examples will be found in the aforementioned Christianson and Bunker patents. The Bunker device in particular has enjoyed commercial success under the trade name "Loveland Levers;" (see *Musicmaker's Keep Book:* 1994–1995 [catalogue], pp. 4–5). A major problem with this type of sharping lever, however, is that forcing a kink into the string is ultimately detrimental to the string and contributes to string breakage. Not only is the string bent in two different directions through the kink, but the cam slides on the string and the string is abraded each time the sharping lever is engaged or disengaged. In effect, the string is pinched between the lever and the fret pin or between two fret pins and such pinching produces deterioration of the string.

A second type of sharping lever has been developed which does not pinch the string or put a reverse kink in it. The most common commercial version of this device is known as a "Robinson lever"; it is illustrated and described in the aforementioned Bunker patent (see Bunker's FIG. 4 and the accompanying portion of the Specification). While a Robinson lever is less deleterious physically to a harp string, Robinson levers have been known to vibrate and to generate an undesirable buzzing sound when in contact with a string being played.

Both the Bunker and Robinson levers are secured to the harp neck by a single screw. If that screw works loose through usage or is insecurely mounted, the entire lever can rotate out of position or move up or down, causing skewed alignment, so that both inaccurate tone and extraneous noise can occur. Further, both the Bunker and Robinson levers (as well as a number of other types of levers) have a bent base to which are attached the fret pin and lever handle. These levers are manufactured by use of a punch press, and while it is intended that the bend in the base should be a precise 90°angle, it is not uncommon for the actual bend produced by the punch press to be either more or less than 90°, causing difficulty in installation alignment. When the screw slot is punched into the base material it may cause the bottom surface of the base to become rounded, resulting in an is insecurely positioned base. The tone transference when such a lever is engaged is hampered by both the dependence of the pin's small area of attachment to the base and the lack of support of the fret pin in relation to the base.

The folk harper is thus faced with having to choose from numerous types of levers which have drawbacks such as (a) excessive string deterioration at the point of lever engagement contact, (b) excessive kinking of the strings leading to early string breakage, (c) buzzing and vibration, (d) over-sharping or under-sharping due to lack of adequate lever stop positioning, (e) insecurely mounted levers, and (f) loss of tone when the lever is engaged.

SUMMARY OF THE INVENTION

The musical tone obtained from a string of a harp is dependent upon four main factors: (a) the type of material of which the string is made, (b) the length of the string, (c) the tension applied to the string, and (d) the mass of the string. True tone quality refers to natural tone quality of a string, whether engaged with or disengaged from a sharping lever. Maintaining true tone quality while the lever is engaged has historically been a problem for makers of sharping levers.

The sharping lever of the present invention avoids the detrimental aspects of the prior art devices, while providing simple and effective sharping of a harp string and obtaining of true tone quality. The present levers are easily and cleanly manipulated by the harper. Their unique shape is resistant to vibration and does not generate any buzzing or other unwanted acoustical effects to interfere with or distort the musical performance of the harp. The unique configuration of the supporting base, the fret pin and the handle allows the device to contact and sharpen the tone of a harp string in a manner which maintains true tone quality. The present sharping levers thus are an improvement over prior levers in that they permit the harper to maintain true tone quality, they do not pinch or kink the harp strings in their operation and they do not vibrate and generate unwanted noise or other acoustical effects. Further, because of their structure and preferred manufacturing method, they are precisely formed without base curvature or deformed angles, and they can be secured to the harp neck in a number of different ways, all of which prevent subsequent early displacement or movement after installation. With the present levers, the string rests on a fret pin which in turn rests directly on the base, providing a firm contact for true tone transference. Thus the harper is provided with a sharping lever which not only avoids the problems experienced with prior art levers, but most importantly allows the harper to maintain true tone with the instrument.

Therefore in one broad embodiment the present invention is of a sharping lever for mounting on a harp and releaseably engaging a string of the harp, comprising a vibration-resistant support; a hand-operable handle pivotally mounted to the support; and a string engaging fret pin projecting from the handle and moveable therewith, the fret pin and the support being in contact when the fret pin is in contact with the string; whereby operation of the handle when the lever is mounted on the harp causes the fret pin to sequentially engage and disengage the harp string, engagement therebetween causing the harmonic tone of the string to be raised, with fret pin and support simultaneously to be in contact and aligned with the string to engage the string without inducing distortion of the raised harmonic tone, and disengagement therebetween causing the harmonic tone of the string to resume its natural frequency.

In another broad embodiment the invention is a sharping lever for releaseably engaging a string of a harp wherein when the sharping lever is mounted on the harp and in contact with the string, the harmonic tone of the string is raised, and the pressure of the string on the sharping lever is transmitted directly through the support to the harp without vibration or distortion of the raised tone of the harp.

In yet another broad embodiment the invention is a sharping lever for mounting on a harp and releaseably engaging a string of the harp, comprising a vibration-resistant metallic support; a hand-operable handle pivotally mounted to the support; and a string engaging metallic fret pin projecting from the handle and moveable therewith, the fret pin and the support being in contact when the fret pin is in contact with the string; whereby when the lever is mounted on the harp operation of the handle causes the fret pin to sequentially engage and disengage the harp string, engagement therebetween causing the string to be displaced and its harmonic tone to be raised, with fret pin and support simultaneously to be in contact and aligned with the string to support the string without inducing distortion of the raised harmonic tone, and disengagement therebetween causing the string to resume its undisplaced position and the harmonic tone of the string to resume its natural frequency.

Preferably the sharping lever of this invention will be positioned and operated such that engagement of the fret pin with the string causes the string's harmonic tone to be raised by one-half tone.

If desired, the sharping lever can also include a stop. Inclusion of a stop is particularly important for use with all wrapped metal strings and with some wrapped nylon strings, to insure that the string is held securely against the fret pin. Stops will be sized to the diameters of the strings to be stopped.

The sharping lever can be made of metallic or non-metallic material, but the former is preferred. It is also preferred to form a metallic sharping lever by machining (of a metal such as hard brass or stainless steel) which results in sharp, accurate bends and curves, a flat base and ample provision for securing and properly aligned mounting of the sharping lever on a harp neck.

The invention also includes harps which incorporate the sharping lever of the present invention.

Numerous significant specific features of the sharping lever will be described below.

BRIEF DESCRIPTION OF THE DRAWINGS

FIGS. 6 and 7 are side elevation views of the sharping lever of FIGS. 3–5, illustrating the sharping action of the device, with FIG. 6 illustrating the device out of engagement with the harp string (shown in phantom) and FIG. 7 illustrating the device (as seen from the opposite side) in engagement with the harp string shown, in phantom).

FIGS. 8A, 8B and 8C illustrate elevation views of three configurations of the string-engaging fret pin of the sharping lever, showing means of accommodation of different sizes harp strings (shown in phantom).

FIGS. 9A, 9B and 9C are top plan views showing different configurations of bases for the sharping lever and positioning of the string-engaging groove in the fret pin.

FIG. 10 is a side elevation view. FIGS. 11 and 12 are both end elevation views taken from the right side of FIG. 10 and showing, respectively, a stop engaged with a small diameter string and a stop engaged with a large diameter string.

DETAILED DESCRIPTION AND PREFERRED EMBODIMENTS

Figure 1:
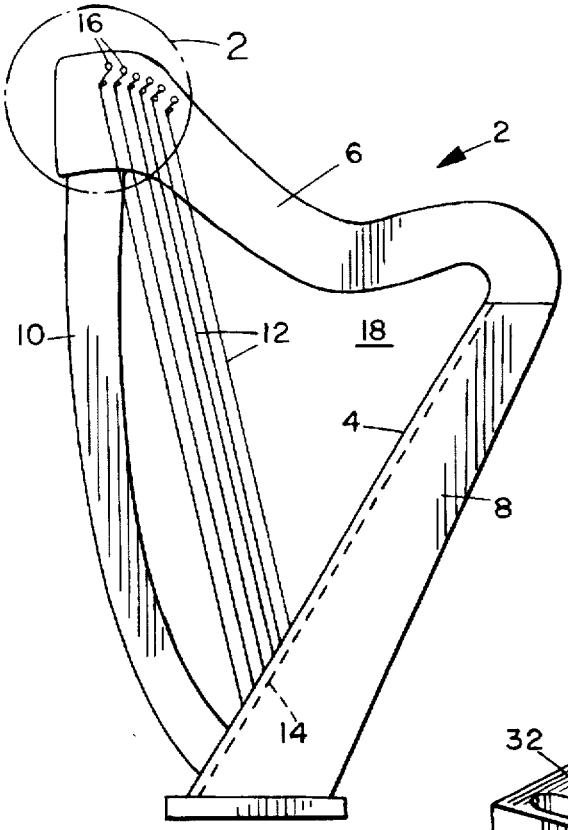
FIG. 1 is a side elevation view of a typical folk harp, showing a representative portion of its strings, and illustrating the location of sharping levers of this invention with respect to such strings.
Figure 3:
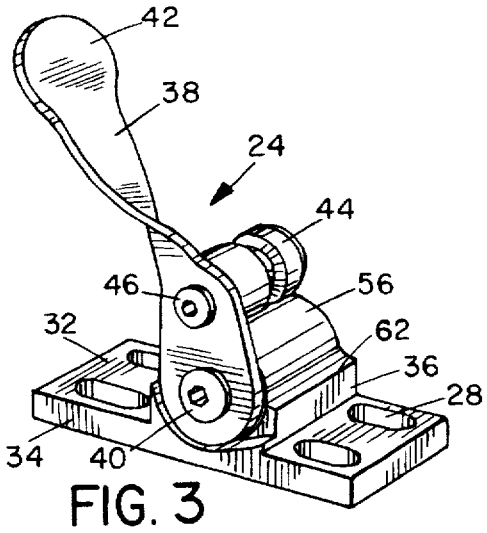
FIG. 3 is a perspective view of a preferred embodiment of a sharping is lever of this invention in the engaged position.

The sharping levers of the present invention are best understood by reference to the drawings. FIG. 1 illustrates a typical folk harp 2 having a neck 6, a sound box or resonator 8 (faced by a sound board 4) and a forepillar 10. Strings 12 are fixed to the sound box 8 at one end 14 and to the neck 6 at the other end 16. While only a few representative strings 12 are actually illustrated, it will be recognized that the strings are arranged in note order across the opening 18. The longer and/or heavier strings produce the lower harmonic tones with the pitch of the note of each sequential string rising as one moves toward the shorter and/or lighter strings. (The actual tone produced by a string will depend on combination of several factors including its length, the material from which it is made and whether or not it is wrapped, which factors are well known to harpers.)

Figure 2:
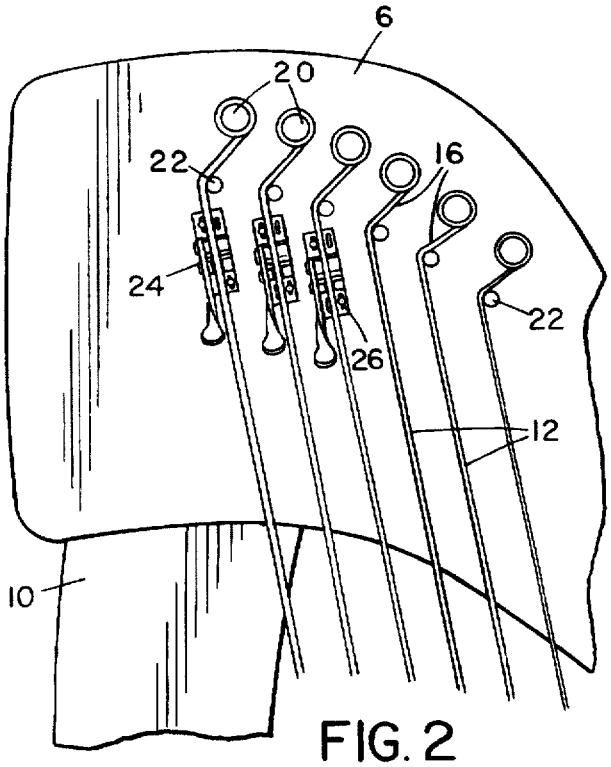
FIG. 2 is an enlarged view of Detail 2 of FIG. 1, showing the location of typical sharping levers on a larger scale.
Figure 5:
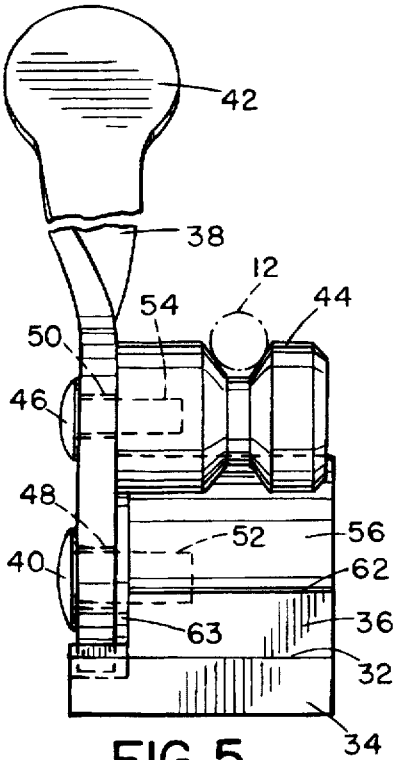
FIG. 5 is a front elevation view of the sharping lever of FIGS. 3 and 4.

As best seen in FIG. 2, the end 16 of each string 12 is attached to the neck 6 by a tuning peg 20 and is spaced from the adjacent strings 12 by being guided around a bridge pin 22. The position of bridge pin 22 not only provides the appropriate spacing of the strings 12 for playing by the harper, but also determines the vibrational length of the string, which length is measured from the bridge pin 22 at end 16 to the sound board connection at end 14. The tuning pegs 20 are turned by a conventional tuning key (not shown) to tighten or loosen each string 12 to tune the string to its correct tension along its entire length between bridge pin 22 and end 14 and thus maintain the precise pitch of its note. The overall length of the string when at the correct tuned tension and its mass determines the basic tone to be played by each string. The string can be tuned to the flat, natural or sharp of a note by changing the string tension using the tuning key. However, once set, the precise note to be played by that string is fixed and, absent the use of a sharping lever, the string will always play the same tone or note. (It will, of course, be recognized that a string's tension will be affected by playing of the harp, which will gradually cause the tuning pegs to loosen over time, and also will be affected by movement of the harp and changes in environmental conditions surrounding the harp, so that retuning is required frequently and commonly is done before each performance and occasionally also between songs.)

Also attached to the neck 6 are a plurality of sharping levers 24 of the present invention. Each sharping lever 24 is aligned with a single string 12 and is mounted on the neck 6 between the neck's surface and the string 12. The sharping lever 24 is attached to the neck 6 by screws 26 positioned through holes 28 in the base 34 of the support 32. In the present invention at least two screws are used to prevent shifting, rotation and vibration of the sharping lever. Depending on the shape of the base 34 two, three or four is screws may be used. While any type of a screw head may be used (such as a round or pan head screw) it is preferred to use button head cap screws each with a hexagonal recess 30 to accommodate a small Allen wrench or hex driver. A hex socket or a Phillips socket are preferred, since Allen wrenches, hex drivers and Phillips screwdrivers are much less prone to slip while tightening the screws than is a conventional blade screwdriver in a slotted screw head, thus minimizing the potential for damage to the sharping lever or the harp neck.

The sharping lever 24, has its main solid body support 32, which includes a flat base 34 containing holes 28 and a pedestal 36, which is integral with the base 34 and rises upwardly from it. It will be seen from the drawings that the support 32, and particularly the pedestal 36, is a relatively massive structure. It is manufactured by metal- and material-working methods, preferably precision machining or molding, which will insure that the base 34 has a flat underside for firm and uniform contact with the surface of neck 6, and also insure that all curves and bends are accurately shaped and angled.

Because of the precise manufacture and size of support 32 and the fact that pedestal 36 extends laterally most or all the way across the base 34, and its firm securement to neck 6, the sharping lever 24 of this invention is essentially fully resistant to rocking or independent vibration. By contrast, prior art devices which have only a thin base (which often has some undue curvature) and a corresponding thin member projecting upward from the base to support the lever handle, are very susceptible to developing their own vibration, presumably at least in part from vibration transmitted through the strings and/or neck. Such independent vibration of the sharping lever, as a noted above, creates buzzing and other unwanted acoustical effects and is thus quite undesirable.

An elongated lever handle 38 is attached at one end by screw 40 to the pedestal 36. Handle 38 may have any length and shape which will allow it to be conveniently manipulated by the harper, and which will not itself interfere with the strings or playing of the strings. Preferably, however, the handle 38 will have a shape generally as shown in FIGS. 3–7 which includes a 90° twist at approximately the mid-point. It will thus sit flush against the washer 63 positioned at the side of pedestal 36 at the end where it is attached by screw 40. By incorporation of the twist and being widened to provide a pad 42, the is handle is readily engaged by the harper's finger for manipulation. Screw 40 passes through hole 48 in handle 38 and though the center hole of washer 63 and is seated in threaded socket 52 in pedestal 36. Washer 63 is preferably a stainless steel Belleville spring washer which provides smooth moving action of the handle 38 to engage and disengage fret pin 44 from string 12. The seating of screw 40 in socket 52 is with just sufficient force to produce a very slight interference fit between the facing surfaces of the pedestal 36, washer 63 and handle 38 so that the smooth movement mentioned above is provided for, while yet insuring that the handle 38 will tend to remain in the position to which it is moved by the harper.

Also attached to the side of handle 38 at a point spaced apart from the location of screw 40 is string-contacting fret pin 44. Fret pin 44 is secured to handle 38 by screw 46 which passes through hole 50. Screw 46 is seated in threaded socket 54 in fret pin 44 in such a manner that the base of fret pin 44 is in slight interference contact with the surface of handle 38, and hole 50 is slightly elongated along the centerline of handle 38 for the purpose to be described below.

Figure 4:
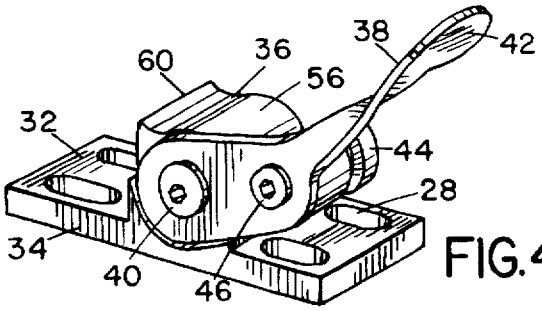
FIG. 4 is a view similar to that of FIG. 3, illustrating the sharping lever in the disengaged position.

In its lowered (i.e., disengaged) position shown in FIGS. 4 and 6, handle 38 is pushed downward toward the base 34 of the support 32, moving s the fret pin 44 out of engagement with the string 12. In its raised (i.e., engaged) position shown in FIGS. 3, 5 and 7 the handle 38 is moved upward and the fret pin 44 comes into engagement with the string 12, raising the string slightly as shown in FIG. 7 and thus shortening its vibrating length and slightly increasing its tension and raising its tone. Normally, it is desired to raise the tone by exactly one-half tone to produce a natural note from a string 11 tuned to a flat note, or to create a sharp note from a string tuned to the natural note. In the present invention, this is accomplished by the shape of the top surface 56 of the pedestal 36 and its cooperation with the fret pin 44.

In the present invention, the top surface 56 of the pedestal 36 is formed is as a circular curve with a radius R centered on the axis of screw 40, hole 48 and socket 52. The hole 50 is positioned in the handle 38 at a distance from the axis of screw 40 and hole 48 such that when fret pin 44 is engaged with is the string 12, fret pin 44 will be in contact with the top surface 56 of pedestal 36. Thus fret pin 44's axis (and that of its coaxial screw 46 passing through hole 50) will be spaced from the axis of screw 40 by a distance equal to the sum of radius R plus the radius of fret pin 44. The slight elongation of hole 50 permits the fret pin 44 to move slightly along the axis of handle 38 so that it can be urged into contact with the surface 56 by the force of string 12. This creates a firm line of contact A—A (FIG. 7) from string 12 through fret pin 44 and support 32 to neck 6, preventing the sharping lever 24 from moving or vibrating when the string is played, and allowing the string's pure note to be sounded. That is, the contact points of the engaged string 12 and fret pin 44 and of the engaged fret pin 44 and the support 32 define a straight line A—A through the base 34 of the support 32, such that the pressure of the string 12 on the sharping lever 24 is transmitted directly and linearly through the support 32 to the folk harp without vibration or distortion of the raised tone of the folk harp. It will be noted that there is a small depression 37 in the top surface 56 just past its crest and before the stop 60. When the lever 24 is properly positioned on the neck 6 and fret pin 44 is seated in depression 37, the point of contact (i.e., on line A—A) between the fret pin 44 and the string 12 is where the precise semi-tone is produced. The depression 37 then cooperates with the pressure of the string 12 to maintain the fret pin 44 at that point so that while the harp is being played the tone produced does not vary.

It is also desirable, but not necessary, that there be a very small gap 58 to provide slight clearance between the radiused surface 56 of pedestal 36 and the outer surface of fret pin 44 when the lever is disengaged (FIG. 6). This is provided by movement of the fret pin screw 46 in the elongated slot 50.

Therefore, as the handle 38 is raised from the disengaged position, the fret pin 44 traverses along the radiused surface 56 of pedestal 36, coming into contact with the string 12, until it seats in depression 37 and sharps the string 12 to the exact semi-tone desired. To prevent the harper from moving the handle too far and moving the fret pin 44 past the end of surface 56, there is a stop in the form of shoulder 60 provided in pedestal 36 to prevent the movement of fret pin 44 past the depression 37. A corresponding stop in the form of shoulder 62 is also provided in surface 56 for the disengaged fret pin 44 at its lowest desired point of travel. The exact position of shoulder 62 at is the lower limit of travel is not critical, and is chosen simply to keep the fret pin 44 from hitting or resting against the base 34 or the screws 26, while yet being sufficiently spaced apart from string 12 so that fret pin 44 remains fully disengaged from string 12 even when string 12 is being vigorously played.

It is possible by modification of the pedestal shape to provide for change of the string tone by other than an exact one-half tone. In those rare instances where a harp is intended to be capable of playing tones other than an exact one-half sharping on string 12, an embodiment of sharping lever 24 may be used in which the position of shoulder 60 is moved further around radiused surface 56 to increase the distance that fret pin 44 can travel. Thus, depending on its diameter, fret pin 44 can engage string 12 before or after it reaches the depression 37 where it produces one-half tone sharping, thus producing a narrow range of different tones from the first point of contact through the semi-tone sharpening at depression 37 and on through additional points of contact until the fret pin 44 reaches the displaced shoulder 60 or becomes disengaged from the string 12. Normally, however, this type of variability is undesirable and unwanted by harpers. Thus, the positioning of shoulder 60 is normally critical, because a harper wants to be able to move the fret pin 44 cleanly and precisely from its fully disengaged position to its fully engaged position seated in depression 37, at exactly the point at which the one-half tone increase is obtained. Consequently, in normal practice, the harper simply moves the handle 38 in a single motion from its terminal position against shoulder 62 to its opposite terminal position against in depression 37 and against shoulder 60 to create the sharpened note and then reverses the motion to revert to the unsharpened tone.

It has been reported that in some of the prior art products there is a tendency for strings to slip away from or off the fret pin during playing of the harp. No such tendency is present in the present sharping lever because of the structure illustrated in the views of corresponding FIGS. 8A, 8B and 8C and 9A, 9B and 9C. A circumferential groove 64 is machined or otherwise formed around the circumference of each fret pin 44. The width of the grooves 64 in fret pins for different strings are designed to accommodate different groups of string sizes and weights (such strings being indicated in the Figures as strings 12, 12' and 12" respectively). The various size strings and weights are thus seated properly within the grooves 64 of the appropriate fret pins so that there is no tendency for a string to be dislodged. FIGS. 8C and 9C illustrate a fret pin groove for a thin treble string 12, FIGS. 8B and 9B illustrate a fret pin groove for a mid-range string 12", and FIGS. 8A and 9A illustrate a fret pin for a bass wire string 12". It will be noted that the grooves are all of equal depth and differ only in their width. The position of the groove 64 along the fret pin 44 will be chosen such that the particular string 12 will not interfere with or block the screws 26 securing the lever 24 to the neck 6, as indicated in FIGS. 9A–C.

The base 34 can have several different configurations, depending on the amount of clearance available between the desired position of the sharping lever 24 on the neck 6 and adjacent bridge pins 22. In one configuration, where there is adequate clearance on all sides, as illustrated in FIG. 9A, the base 34 is preferably a rectangle with several (in this case four) mounting slots 28. The installer can use any combination of at least two screws and mounting slots to secure the lever 24 to the neck 6. It is preferred to mount base 34 with two screws 26 placed through a pair of diagonally opposed slots 28 to secure the lever 24 to the neck 6.

In the past the lever installation process has involved first placing the lever its proper position, marking the position of the screw hole, then removing the lever and the string from the harp so that the screw hole could be drilled in the neck, and then reinstalling the lever and string. The present device is much more easily installed, in that the installer may leave the harp string in place and still drill the proper screw holes and install the screws, which provides for much quicker and easier lever installation. It will be noted that the slots 28 are oval shaped. This allows for a degree of fine tuning or "regulation" of the location of the lever 24, so that after the installer gets the lever 24 loosely secured to the neck 6, he or she can then move the lever slightly in either axial direction of the slots 28 to align the lever 24 so that it engages the string 12 at precisely at the semi-tone location. Once that alignment (regulation) is completed, the screws 26 are tightened to secure the lever 24 in its accurate location.

Where clearance with a bridge pin 22 is a problem, as illustrated in FIG. 9B, the base 34 can be configured with a segment removed to provide for clearance with the pin 22. In yet another alternative, shown in FIG. 9C, the base 34 extends only to one side of the pedestal 36. This allows the same uniformly shaped sharping levers to be used for an entire harp, regardless of where clearance with adjacent pins is ample or is a problem. Any disadvantage of the base shape in FIG. 9C where the sharping lever 24 is secured to the neck by only one end of the base 34 is offset by the use of two screws 26.

Figure 10:
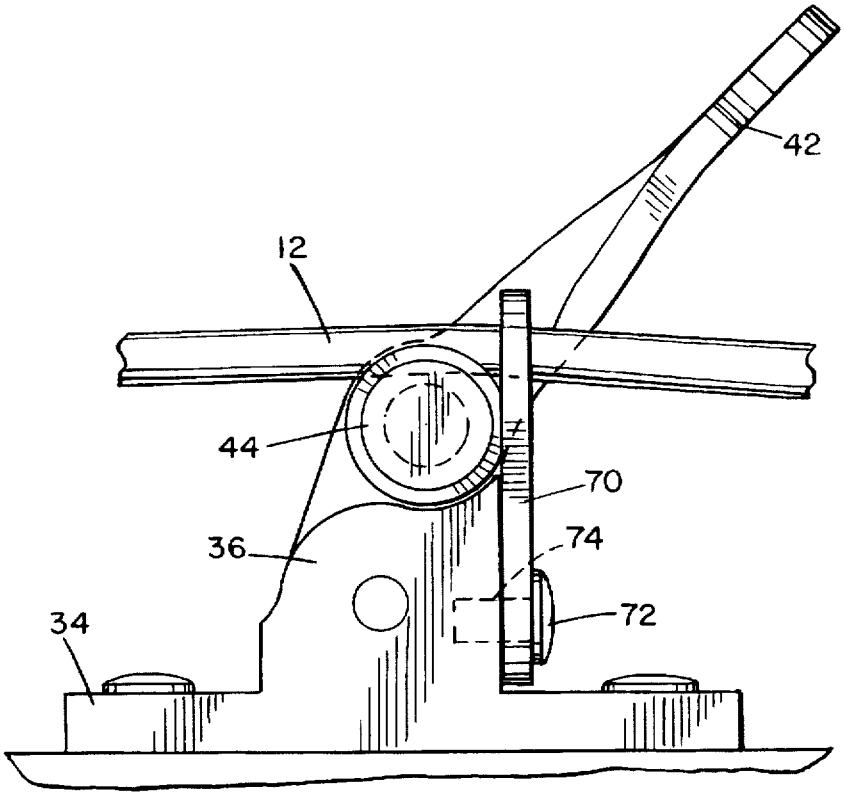
FIGS. 10, 11 and 12 illustrate embodiments of the sharping lever which include a stop.
Figure 11:
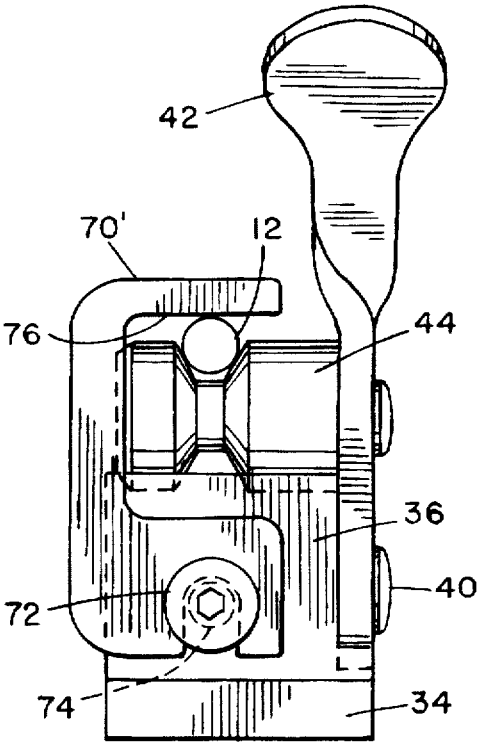
Figure 12:
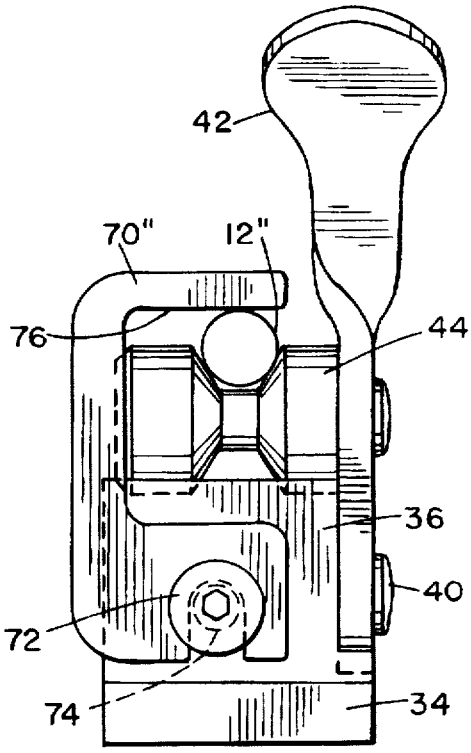

For all wrapped metal wires and for some wrapped nylon wires, it is preferable to include a stop 70 in the sharping lever 24 to hold the string 12 firmly against the fret pin 44, as illustrated in FIGS. 10–12. The stop 70 is formed from a thin piece of metal and secured to the pedestal 36 with screw 72. The stop 70 has a generally C-shaped configuration with the upper portion projecting over the string 12 and having the underside 76 of the upper portion adapted to engage the string 12, as shown in FIGS. 10–12. The stop 70 is moveable up or down by loosening screw 72 which is seated in slot 74 in the lower portion of the stop 70, so that it can be raised or lowered to accommodate strings 12 of different diameters, as illustrated at 70" and 70" in FIGS. 11 and 12, respectively. The slot 74 has enough length to allow it to be flush at the bottom (touching the base) or raised slightly yet still be firmly held by the screw 72 when tightened. This allows adjustment across the range of string diameters recommended for each stop.

The size of the stop 70 will be determined by the size of the string 12 to be stopped. Generally all wrapped metal strings and those wrapped nylon strings with diameters of at least 72 mils (1.83 mm) will require stops. A convenient assortment of stops may include a "small" stop for strings of less than 55 mils (1.40 mm) diameter, a "medium" stop for strings of 55–110 mils (1.40–2.79 mm) diameter, and a "large" stop for strings of greater than is 110 mils (2.79 mm) diameter. Of course, stops can be used wherever desirable, and are not limited solely to use with wrapped metal or nylon strings.

The sharping levers of the present invention may be made of any convenient metallic or non-metallic material which can be shaped to form clean, accurate curved and flat surfaces and precise angles and which does not have an adverse effect on the materials of the strings 12 or neck 6. Most importantly the material chosen must be such that a true tone is rendered by the string when the lever is engaged. Typically the sharping levers will be made of metal, and less often from hard plastic. Particularly preferred are metals such as hard brass, aluminum or stainless steel which are readily machined to the desired configurations. Softer metals, such as copper or soft brass, are less desirable since they will wear faster. Plastics will be the most common non-metallic materials used, but are less favored, since the physical properties of some plastics are such that they may tend to depress the tone, rendering it dull and less true. Many of the suitable non-metals are composite materials formed of fiber-reinforced polymers, where the fibers are of glass, carbon or the like. Non-metal levers are usually formed by molding to the desired configurations rather than being machined. If desired, and depending on the specific material used, one can also impart color or texture by anodizing, coating, dyeing, etc. Those skilled in the art will have no difficulty selecting optimum materials and fabrication methods.

The size of the sharping levers will be a matter of choice for each harper, and will of course be designed to be accommodated by the particular size of harp involved. Typical dimensions of a sharping lever of the present invention, intended to be used for a variety of the more common size harps, has a base 34 which is 15/16" long by 3/8"

wide (24×9.5 mm) and a pedestal 36 which is ⅜" high (9.5 mm) from the bottom of the base 34 to the tip of the shoulder 60. The handle 38 from the centerline of hole 50 to the outer extremity of pad 42 is 15/16" (24 mm) long and fret pin 44 is 3/16" (4.7 mm) in diameter.

It will be evident that there are numerous embodiments of this invention which, while not expressly described above, are clearly within the scope and spirit of the invention. The above description is, therefore, intended to be exemplary only, and the full scope of the invention is to be determined solely 168 by the appended claims.

I claim:

1. A sharping lever for mounting on a folk harp and releasably engaging a string of said folk harp, comprising:

a vibration-resistant support for attachment securely to said folk harp;

a hand-operable handle pivotally mounted to said support; and a string engaging fret pin projecting from said handle and moveable therewith, said fret pin and said support being in contact when said fret pin is in contact with said string;

the contact points of engaged string and fret pin and of engaged fret pin and support defining a straight line through a base of said support;

whereby operation of said handle when said lever is mounted on said folk harp causes said fret pin to sequentially engage and disengage said string, engagement therebetween causing the tone of said string to be raised, with engaged string, fret pin and support aligned without inducing distortion of said raised tone, and disengagement therebetween causing said tone of said string to resume its natural frequency.

2. A sharping lever as in claim 1 wherein said engagement of said fret pin with said string causes said tone to be raised by one-half tone.

3. A sharping lever as in claim 2 further comprising a stopping member incorporated in said support which prevents movement of said fret pin past the position of engagement where the one-half tone increase is obtained.

4. A sharping lever as in claim 1 wherein said support has a curved top surface and when said fret pin is moved while engaged with said string said fret pin contacts and travels along said top surface.

5. A sharping lever as in claim 4 wherein at least a portion of said top surface has a circular curve and said handle is pivotally mounted to said support at the focus of said circular curve.

6. A sharping lever as in claim 1 wherein said fret pin comprises a cylindrical fret pin attached to said handle at one end thereof.

7. A sharping lever as in claim 6 wherein said fret pin contains a string-engaging circumferential groove.

8. A sharping lever as in claim 7 wherein width of said groove is determined by the diameter of said string to be engaged.

9. A sharping lever as in claim 1 wherein said support includes a base having means for securing said support to said folk harp in a manner to prevent movement or vibration of said support.

10. A sharping lever as in claim 9 further comprising elongated slots in said base through which fasteners for securing said lever to said folk harp are placed, said slots permitting regulation of the location of said lever on said folk harp.

11. A sharping lever as in claim 1 further comprising an adjustable holding stop to secure said string against said fret pin when said stop is engaged and said string is plucked.

12. A folk harp comprising:

interconnected neck, soundbox and forepillar;

at least one string connected to and extending between said neck and soundbox to produce a predetermined audible harmonic tone; and a sharping lever as in claim 11 mounted on said neck adjacent to said string and disposed to be capable of operable engagement therewith;

whereby operation of said sharping lever sequentially engages and disengages said harp string, engagement therebetween causing said string to be displaced and its harmonic tone to be raised, and disengagement therebetween causing said string to resume its undisplaced position and said harmonic tone of said string to-resume its natural frequency.

13. A folk harp comprising:

interconnected neck, soundbox and forepillar;

at least one string connected to and extending between said neck and soundbox to produce a predetermined audible harmonic tone; and a sharping lever as in claim 1 mounted on said neck adjacent to said string and disposed to be capable of operable engagement therewith;

whereby operation of said sharping lever sequentially engages and disengages said harp string, engagement therebetween causing said string to be displaced and its harmonic tone to be raised, and disengagement therebetween causing said string to resume its undisplaced position and said harmonic tone of said string to resume its natural frequency.

14. A sharping lever for mounting on a folk harp and releasably engaging a string of said folk harp, comprising:

a vibration-resistant metallic support for attachment securely to said folk harp;

a hand-operable handle pivotally mounted to said support; and a string engaging metallic fret pin projecting from said handle and moveable therewith, said fret pin and said support being in contact when said fret pin is in contact with said string;

the contact points of engaged string and fret pin and of engaged fret pin and support defining a straight line through a base of said support;

whereby when said lever is mounted on said folk harp operation of said handle causes said fret pin to sequentially engage and disengage said string, engagement therebetween causing said string to be displaced and its tone to be raised, with engaged string, fret pin and support aligned without inducing distortion of said raised tone, and disengagement therebetween causing said string to resume its undisplaced position and said tone of said string to resume its natural frequency.

15. A sharping lever as in claim 14 wherein said engagement of said fret pin with said string causes said tone to be raised by one-half tone.

16. A sharping lever as in claim 14 wherein said support includes a base having means for securing said support to said folk harp in a manner to prevent movement or vibration of said support.

17. A sharping lever as in claim 16 wherein when said sharping lever is mounted on said folk harp by said base and in contact with said string, the tone of said string is raised, and the pressure of said string on said sharping lever is transmitted directly through said support to said folk harp without vibration or distortion of said raised tone of said folk harp.

18. A sharping lever as in claim 14 wherein said metallic support has a curved top surface and when said metallic fret pin is moved while engaged with said string said fret pin contacts and travels along said top surface.

19. A sharping lever as in claim 18 wherein at least a portion of said top surface has a circular curve and said handle is pivotally mounted to said support at the focus of said circular curve.

20. A sharping lever as in claim 14 further comprising an adjustable holding stop to secure said string against said fret pin when said stop is engaged and said string is plucked.

* * * * *